US006174104B1

(12) United States Patent
Fields

(10) Patent No.: US 6,174,104 B1
(45) Date of Patent: Jan. 16, 2001

(54) HIGHWAY MARKING TAPE REMOVAL APPARATUS

(76) Inventor: Douglas J. Fields, 5019 Sunscape Cir., Apt. 1810, Indianapolis, IN (US) 46237

( * ) Notice: Under 35 U.S.C. 154(b), the term of this patent shall be extended for 0 days.

(21) Appl. No.: 09/226,902

(22) Filed: Jan. 8, 1999

Related U.S. Application Data

(60) Provisional application No. 60/070,856, filed on Jan. 9, 1998.

(51) Int. Cl.[7] ..... E01C 23/16
(52) U.S. Cl. ..... 404/94; 404/83; 404/93
(58) Field of Search ..... 404/93, 94, 83, 404/84.05

(56) References Cited

U.S. PATENT DOCUMENTS 3,318,753 * 5/1967 Whitlow .
3,740,297 * 6/1973 Vidinsky .
4,030,958 * 6/1977 Stenemann ..... 156/350
4,242,173 * 12/1980 Stenemann ..... 156/523
4,317,696 * 3/1982 Hutchinson et al. .
4,796,711 * 1/1989 Chrysler .
5,236,051 * 8/1993 Sawyer et al. ..... 172/438
5,452,652 * 9/1995 Brooks ..... 100/7
5,772,359 * 6/1998 Marty ..... 404/94
6,029,729 * 2/2000 Sieber et al. ..... 156/577

* cited by examiner

*Primary Examiner*—Eileen D. Lillis
*Assistant Examiner*—Gary S. Hartmann
(74) *Attorney, Agent, or Firm*—Barnes & Thornburg

(57) ABSTRACT

A tape removal apparatus adapted to be towed behind a vehicle for removing marking tape from a road comprises a road frame hitched to the vehicle and having a pair of wheels to allow the road frame to be towed behind the vehicle and a pickup mast having a center section coupled to the road frame, a lower section extending from the center section toward the road and having a drive roller configured to engage the tape on the road to remove the tape from the road, an upper section extending from the center section toward the vehicle, and a pinch roller. The pinch roller is configured to receive the tape from the drive roller as the tape removal apparatus is towed behind the vehicle.

39 Claims, 4 Drawing Sheets

HIGHWAY MARKING TAPE REMOVAL APPARATUS

CROSS REFERENCE TO RELATED APPLICATIONS

This application claims priority under 35 U.S.C. § 119(e) to U.S. provisional application Ser. No. 60/070,856, filed Jan. 9, 1998.

BACKGROUND OF THE INVENTION

This invention relates to highway repair equipment. In the repair of highways, it is often necessary to close lanes of a highway and reroute traffic onto other lanes to permit the closed lanes to be repaired. When this is done, it is common practice to warn motorists, not only by the posting of appropriate signage, but also by remarking the lane boundaries. Because the remarking of lane boundaries is temporary, it is not desirable to remark the lane boundaries with paint or any other type of relatively more permanent marking. Reflective or other types of high visibility tape have become the lane boundary marking of choice for many types of highway repair projects. This tape can then be removed from the repaired section of highway after the repair is complete and discarded. Until now, the removal of the tape has been performed manually, with the repair crew walking the section of repaired highway and pulling the temporary marking tape up in short sections. This is time consuming and labor intensive. It is an object of the invention to provide a less labor intensive and quicker way to remove temporary highway marking tape.

SUMMARY OF THE INVENTION

According to the invention, an apparatus for removing marking tape from a road comprises a first roller configured to engage the tape to remove the tape from the road as the roller is rotated.

Illustratively according to the invention, the apparatus further comprises a drive mechanism coupled to the first roller to rotate the first roller.

Further illustratively according to the invention, the drive mechanism comprises a second roller configured to engage the road so that rotation of the second roller along the road causes rotation of the first roller.

Additionally illustratively according to the invention, the apparatus comprises a mechanism for permitting adjustment of the downward force of the second roller on the road.

Illustratively according to the invention, the apparatus further comprises a third roller positioned to define between the first roller and the third roller a space. The tape extends into the space and is engaged by the first and third rollers.

Further illustratively according to the invention, the apparatus comprises a mast for supporting the first roller.

Additionally illustratively according to the invention, the mast includes a center section and a lower section movably coupled to the center section and having a non-use orientation and a use orientation with respect to the center section. The lower section extends from the center section toward the road when in the use orientation. The first roller is coupled to the lower section.

Illustratively according to the invention, the center section and the lower section are pivotally coupled.

Further illustratively according to the invention, the lower section is movable to position the lower section in a non-use orientation on top of the center section.

Additionally illustratively according to the invention, the mast further includes an upper section movably coupled to the center section and having a non-use orientation and a use orientation with respect to the center section. The upper section extends from the center section in a direction generally opposite the lower section when both the lower section and the upper section are in use orientations.

Illustratively according to the invention, the center section and the upper section are pivotally coupled.

Further illustratively according to the invention, the upper section is movable about the pivot to position the upper section in a non-use orientation on top of the center section.

Additionally illustratively according to the invention, the apparatus further comprises a road frame for supporting the mast. The mast is coupled to the road frame.

Illustratively according to the invention, the apparatus further comprises a carriage for movably supporting the mast from the road frame.

Further illustratively according to the invention, one of the carriage and the road frame includes a fourth roller configured to permit the carriage to move transversely relative to the road frame.

Additionally illustratively according to the invention, one of the carriage and the road frame includes a track. The fourth roller rides along the track.

Illustratively according to the invention, one of the carriage and the road frame includes at least one stop to limit the travel of the carriage relative to the road frame.

Further illustratively according to the invention, the road frame includes a pair of road wheels to permit travel of the road frame.

Additionally illustratively according to the invention, the carriage further includes a motor coupled to the carriage to move the carriage relative to the road frame.

Illustratively according to the invention, the mast is movably coupled to the carriage.

Further illustratively according to the invention, the apparatus comprises a motor coupled to the mast and the carriage to move the mast relative to the carriage.

BRIEF DESCRIPTION OF THE DRAWINGS

The invention may best be understood by referring to the following description and accompanying drawings which illustrate the invention. In the drawings.

DETAILED DESCRIPTION OF AN ILLUSTRATIVE EMBODIMENT

Figure 3:
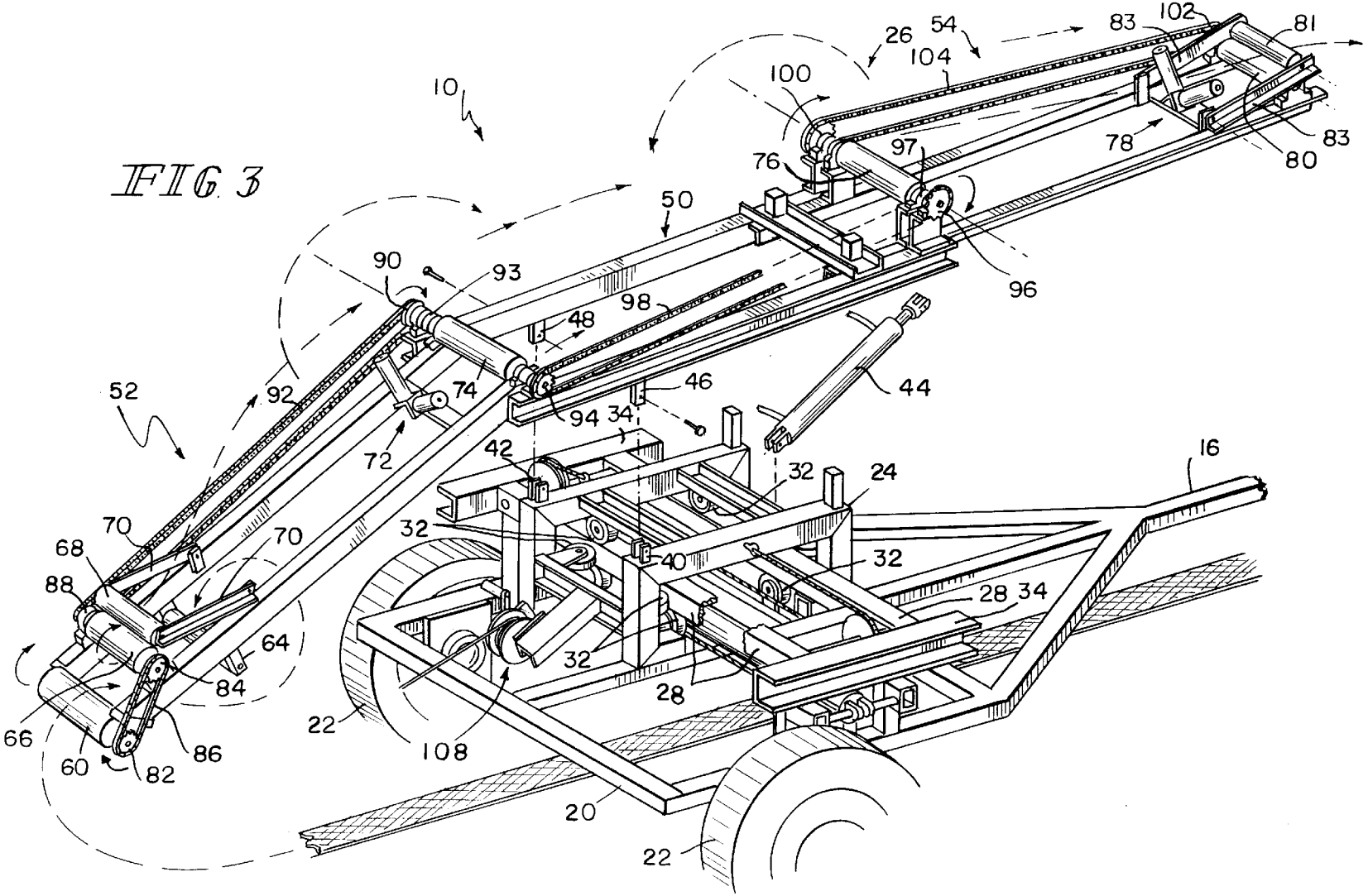
FIG. 3 illustrates a partly exploded perspective view of the apparatus of FIG. 2.
Figure 4:
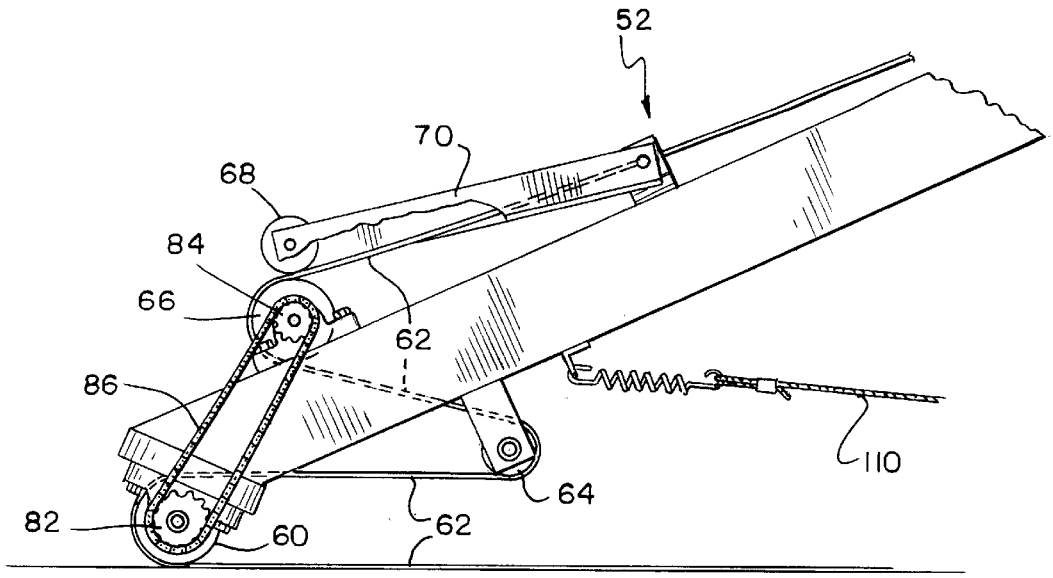
FIG. 4 illustrates an enlarged fragmentary sectional side elevational view of a detail of the apparatus illustrated in FIGS. 1–3.

Referring now to the FIGS. , a highway lane marking tape removal apparatus IO constructed according to the invention is illustrated. Apparatus 10 is adapted to be towed behind a vehicle 12 such as, for example, a stake truck, pickup truck or the like. The vehicle 12 and a tongue 16 of the apparatus 10 are provided with the complementary components of a towing hitch 18. As best illustrated in FIG. 3, the apparatus 10 comprises a road frame 20 including a pair of ground engaging wheels 22, a shifting carriage 24 which permits the apparatus to pick up marking tape from, for example, either edge of a lane of temporarily marked highway section, and a pickup mast 26. The components 20, 24, 26 can be of any suitably durable configuration, but will ordinarily be constructed from metal, for example, steel beams welded or otherwise suitably joined in a manner to withstand the rigors of highway repair.

Figure 1:
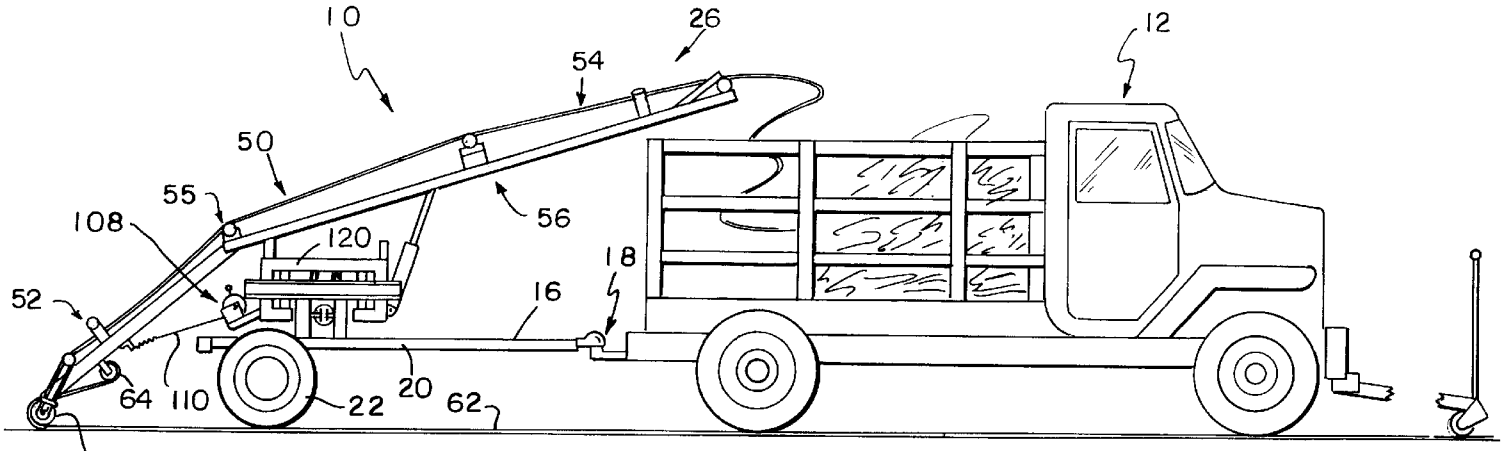
FIG. 1 illustrates a side elevational view of an apparatus constructed according to the invention in its use orientation being towed behind a truck fitted with a lane edge indicator.
Figure 2:
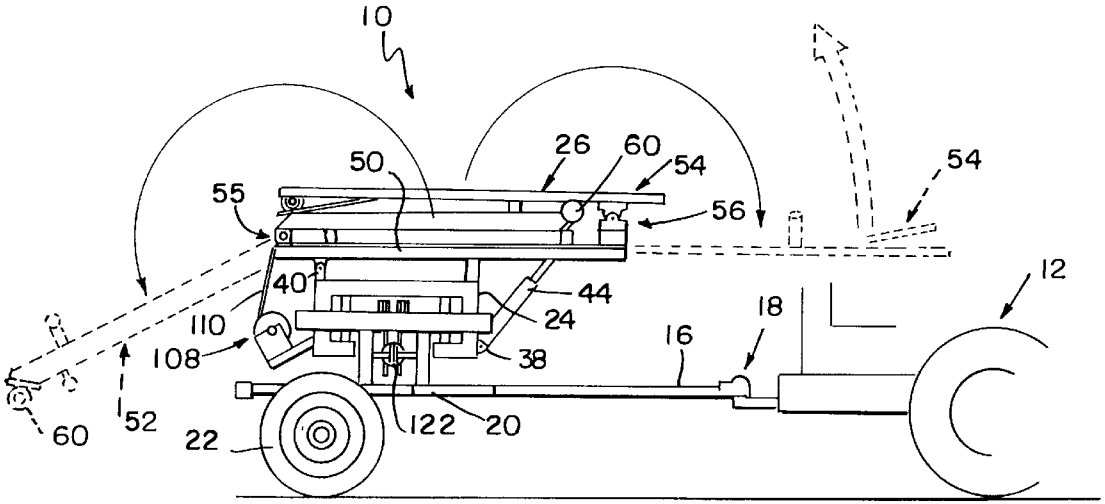
FIG. 2 illustrates a side elevational view of an apparatus constructed according to the invention in folded, non-use orientation suitable for transportation of the apparatus to and from a worksite.
Figure 5:
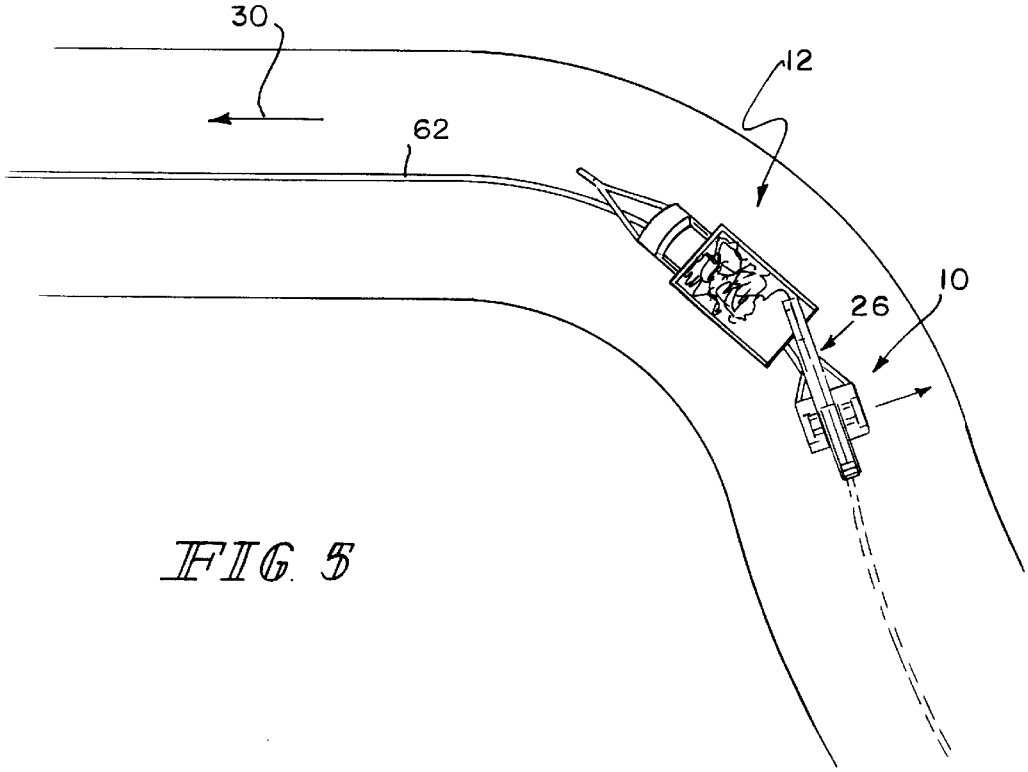
FIG. 5 illustrates an overhead view of the apparatus of FIGS. 1–4 in use.

The road frame includes a transversely extending track 28 upon which the shifting carriage 24 is supported for movement transversely of the direction 30 (FIG. 5) of travel of the towing vehicle 12. The shifting carriage 24 is provided with rollers 32 which retain the shifting carriage 24 on the road frame 20, while permitting the shifting carriage 24 to move transversely along track 28. Appropriate stops 34 are provided at the ends of track 28 at the limits of shifting carriage 24's travel on track 28. Shifting carriage 24 has three mounting points 38, 40, 42 for one end of a fluid actuator 44, such as, for example, a linear hydraulic motor, and for two complementary mounting points 46, 48 of a center section 50 of the mast 26. The mast 26 comprises center section 50, a road engaging lower section 52, and an upper section 54. Center section 50 and lower section 52 are articulated at a pivot 55. Center section 50 and upper section 54 are articulated at a pivot 56. This articulation facilitates transportation of apparatus 10 to and from worksites, as illustrated in FIG. 2.

When mast 26 is in its use orientation illustrated in FIGS. 1 and 3–5, a ground-engaging drive roller 60 having a width somewhat wider than the width of the tape 62 which is to be picked up is rested on the tape 62. A leader of the tape 62 is taken up manually and is threaded around roller 60, a roller 64, and between a roller and a companion roller 68 mounted on swing arms 70 to lower section 52. The tape is then fed upward along lower section 52 over a roller fairlead 72 and over a roller 74 mounted adjacent pivot 55. The tape 62 is then fed over a roller 76 adjacent pivot 56 and over a roller fairlead 78 near the upper extent of upper section 54. Finally the tape is threaded between a roller 80 and a roller 81 mounted on swing arms 83 at the top of upper section 54. Rollers 60, 66 are coupled together by sprockets 82, 84, mounted at one end of each of rollers 60, 66, respectively, and a roller drive chain 86 trained about these sprockets 82, 84.

A drive sprocket 88 at the end of roller 66 opposite sprocket 84 and a companion sprocket 90 on the same shaft 93 as roller 74 are coupled together by a roller drive chain 92. A drive sprocket 94 on the end of shaft 93 opposite sprocket 90 and a companion sprocket 96 at an end of the shaft 97 supporting roller 76 are coupled together by a roller drive chain 98. Shaft 93 drives sprocket 94 in response to rotation of sprocket 90. Rollers 74, 76 are idler rollers, spinning freely on shafts 93, 97, respectively. A drive sprocket 100 at the end of shaft 97 opposite sprocket 96 and a companion sprocket 102 at an end of roller 80 are coupled together by a roller drive chain 104. Shaft 97 drives sprocket 100 in response to rotation of sprocket 96.

The drive ratios of all of sprockets 82, 84, 88, 90, 94, 96, 100, 102 can be any suitable ratios. Illustrative ratios are 1:0.78:0.94:1.17:1.17:1.17:1.17:0.67, all referenced to the number of teeth of sprocket 82. Considerations in determining the ratios include the tape 62's tendency to stretch, and that at least the pinch rolls 66, 68 and 80, 81 may stretch the tape 62 if rollers 66, 80 are turned faster than roller 60. On the other hand, if roller 60 is turned faster than roller 66, a loop of tape of increasing size may accumulate at least between roller 60 and pinch rolls 66, 68 prior to being picked up between pinch rolls 66, 68. A certain amount of slip can typically be tolerated by the remaining rollers, since the tape 62 that has been picked up by rollers 60, 66, 68 flows over these rollers. Friction over rollers 60 and 66 pulls the tape 62. Rollers 60, 66 and 80 are rubber covered to enhance friction between these rollers and the tape 62.

In any event, the tape 62 which is picked up by roller 60 is pulled between the pinch rollers 66, 68 and then flows over rollers 74, 76 and between the pinch rolls 80, 81 and is ejected upward and forward into the bed of the vehicle 12 to be disposed of in any suitable manner. See FIG. 1. Fairleads 72, 78 help guide the tape 62 among the rollers 60, 64, 66, 68, 74, 76, 80, 81. Appropriate friction between roller 60 and the tape 62 being picked up to transmit drive power not only to roller 66, but also to roller 80 is provided by a winch 108 mounted on shifting carriage 24. A tensioning cable 110 wound on winch 108 has its free end coupled to the lower section 52. This permits adjustment of the downward force of roller 60 onto the tape 62 to be picked up. Because the remaining tape 62 pickup apparatus is driven from roller 60, roller speed is always relative to ground speed. Response to changes in speed is therefore essentially instantaneous.

Figure 6:
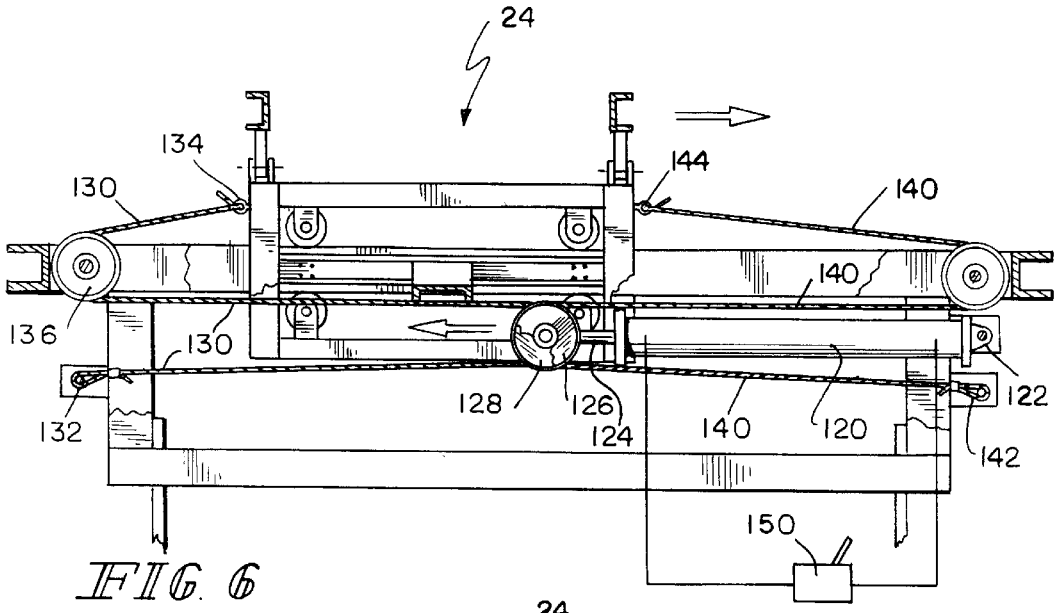
FIG. 6 illustrates an enlarged, fragmentary, partly schematic front view of a detail of the apparatus illustrated in FIGS. 1–5 in a first orientation.
Figure 7:
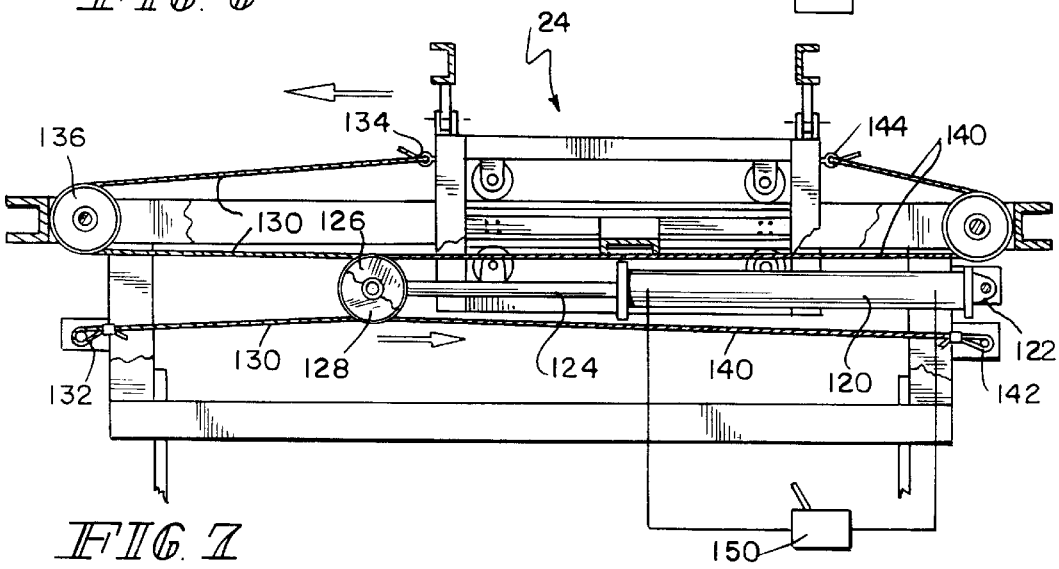
FIG. 7 illustrates a front view of the apparatus illustrated in FIG. 6 in another orientation; and, FIG. 8 illustrates a fragmentary sectional view of the apparatus illustrated in FIGS. 6–7, taken generally along section lines 8—8 of FIGS. 6–7.
Figure 8:
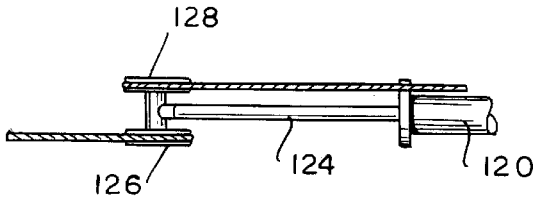

The illustrated shifting carriage 24 and its drive mechanism will now be described in connection with FIGS. 6–8. A double acting hydraulic cylinder motor 120 is mounted at one of its ends 122 to the road frame 20. A piston rod 124 extends from the other end of motor 120 and rotatably supports two pulleys 126, 128. A first length of cable 130 has its ends 132, 134 coupled to the road frame 20 and the shifting carriage 24, respectively. Cable 130 is trained about pulley 126 and about a third pulley 136 rotatably mounted on road frame 20. A second length of cable 140 has its ends 142, 144 coupled to the road frame 20 and the shifting carriage 24, respectively. In this way, actuation of motor 120 steers the shifting carriage 24, and the mast 26 which is mounted on shifting carriage 24, back and forth across the lane of temporarily marked highway section to orient the shifting carriage 24 and mast 26 to facilitate removal of the marking tape 62 from the lane of temporarily marked highway section. The vehicle 12's hydraulic system can be used as a source of pressurized hydraulic fluid, and a manual hydraulic control 150 can be provided for this purpose, for example, on the back of the vehicle 12 bed.

What is claimed is:

1. Apparatus for removing marking tape from a road, the apparatus comprising a first roller configured to engage the tape to remove the tape from the road as the first roller is rotated, a second roller positioned to define between the first and second rollers a space, the tape extending into the space and being engaged by the first and second rollers, and a drive mechanism coupled to the first roller to rotate the first roller the drive mechanism comprising a third roller configured to engage the road so that rotation of the third roller along the road causes rotation of the first roller.

2. The apparatus of claim 1 further comprising a mechanism for permitting adjustment of the downward force of the third roller on the road.

3. Apparatus for removing marking tape from a road, the apparatus comprising a first roller configured to engage the tape to remove the tape from the road as the roller is rotated, and a drive mechanism coupled to the first roller to rotate the first roller, the drive mechanism comprising a second roller configured to engage the road so that rotation of the second roller along the road causes rotation of the first roller.

4. The apparatus of claim 3 further comprising a mechanism for permitting adjustment of the downward force of the second roller on the road.

5. The apparatus of claim 3 further comprising a third roller positioned to define between the first roller and the third roller a space, the tape extending into the space and being engaged by the first and third rollers.

6. The apparatus of claim 5 further comprising a mast for supporting the first roller.

7. The apparatus of claim 6 wherein the mast includes a center section and a lower section movably coupled to the center section and having a non-use orientation and a use orientation with respect to the center section, the lower section extending from the center section toward the road when in the use orientation, the first roller being coupled to the lower section.

8. The apparatus of claim 7 wherein the center section and the lower section are pivotally coupled.

9. The apparatus of claim 7 wherein the lower section is movable to position the lower section in a non-use orientation on top of the center section.

10. The apparatus of claim 6 wherein the mast further includes an upper section movably coupled to the center section and having a non-use orientation and a use orientation with respect to the center section, the upper section extending from the center section in a direction generally opposite the lower section when both the lower section and the upper section are in use orientations.

11. The apparatus of claim 10 wherein the center section and the upper section are pivotally coupled.

12. The apparatus of claim 11 wherein the upper section is movable about the pivot to position the upper section in a non-use orientation on top of the center section.

13. The apparatus of claim 6 further comprising a road frame for supporting the mast, the mast being coupled to the road frame.

14. The apparatus of claim 13 further comprising a carriage for movably supporting the mast from the road frame.

15. The apparatus of claim 14 wherein one of the carriage and the road frame includes a fourth roller configured to permit the carriage to move transversely relative to the road frame.

16. The apparatus of claim 15 wherein one of the carriage and the road frame includes a track, the fourth roller riding along the track.

17. The apparatus of claim 16 wherein one of the carriage and the road frame includes at least one stop to limit the travel of the carriage relative to the road frame.

18. The apparatus of claim 13 wherein the road frame includes a pair of road wheels to permit travel of the road frame.

19. The apparatus of claim 14 wherein the carriage further includes a motor coupled to the carriage to move the carriage relative to the road frame.

20. The apparatus of claim 14 wherein the mast is movably coupled to the carriage.

21. The apparatus of claim 20 further comprising a motor coupled to the mast and the carriage to move the mast relative to the carriage.

22. Apparatus for removing marking tape from a road, the apparatus comprising a first roller configured to engage the tape to remove the tape from the road as the roller is rotated, and a mast for supporting the first roller. the mast including a center section and a lower section movably coupled to the center section and having a non-use orientation and a use orientation with respect to the center section, the lower section extending from the center section toward the road when in the use orientation, the first roller being coupled to the lower section.

23. The apparatus of claim 22 wherein the center section and the lower section are pivotally coupled.

24. The apparatus of claim 22 wherein the lower section is movable to position the lower section in a non-use orientation on top of the center section.

25. The apparatus of claim 22 wherein the mast further includes an upper section movably coupled to the center section and having a non-use orientation and a use orientation with respect to the center section, the upper section extending from the center section in a direction generally opposite the lower section when both the lower section and the upper section are in use orientations.

26. The apparatus of claim 25 wherein the center section and the upper section are pivotally coupled.

27. The apparatus of claim 26 wherein the upper section is movable about the pivot to position the upper section in a non-use orientation on top of the center section.

28. Apparatus for removing marking tape from a road, the apparatus comprising a first roller configured to engage the tape to remove the tape from the road as the roller is rotated, a mast for supporting the first roller, a road frame, and a carriage for movably supporting the mast from the road frame, one of the carriage and the road frame including a fourth roller configured to permit the carriage to move transversely relative to the road frame.

29. The apparatus of claim 28 wherein one of the carriage and the road frame includes a track, the fourth roller riding along the track.

30. The apparatus of claim 29 Wherein one of the carriage and the road frame includes at least one stop to limit the travel of the carriage on the road frame.

31. The apparatus of claim 28 wherein the road frame includes a pair of road wheels to permit travel of the road frame.

32. The apparatus of claim 28 a wherein the carriage further includes a motor coupled to the carriage to move the carriage relative to the road frame.

33. The apparatus of claim 28 wherein the mast is pivotally coupled to the carriage.

34. The apparatus of claim 33 further comprising a motor coupled to the mast and the carriage to move the mast relative to the carriage.

35. Apparatus for removing marking tape from a road the apparatus comprising a first roller configured to engage the tape to remove the tape from the road as the roller is rotated, a road frame for supporting the first roller, and a carriage for movably supporting the roller from the road frame. one of the carriage and the road frame including a second roller configured to permit the carriage to move relative to the road frame.

36. The apparatus of claim 35 wherein one of the carriage and the road frame includes a track, the second roller riding along the track.

37. The apparatus of claim 36 wherein one of the carriage and the road frame includes at least one stop to limit the travel of the carriage relative to the road frame.

38. The apparatus of claim 35 wherein the carriage further includes a motor coupled to the carriage to move the carriage relative to the road frame.

39. The apparatus of claim 35 wherein the road frame includes a pair of road wheels to permit travel of the road frame.

* * * * *